US007891301B2

(12) United States Patent
Marguet et al.

(10) Patent No.: US 7,891,301 B2
(45) Date of Patent: Feb. 22, 2011

(54) TRANSPORT INSTALLATION BY AERIAL ROPE COMPRISING A VEHICLE TRANSFER CIRCUIT EQUIPPED WITH A TORQUE MOTOR

(75) Inventors: Gerard Marguet, Noyarey (FR); Christian Mathieu, Seyssins (FR); Franckie Tamisier, Saint-Nazaire-les-Eymes (FR)

(73) Assignee: Pomagalski SA., Fontaine (FR)

( * ) Notice: Subject to any disclaimer, the term of this patent is extended or adjusted under 35 U.S.C. 154(b) by 284 days.

(21) Appl. No.: 12/216,167

(22) Filed: Jun. 30, 2008

(65) Prior Publication Data

US 2009/0013894 A1 Jan. 15, 2009

(30) Foreign Application Priority Data

Jul. 10, 2007 (FR) ..... 07 04980

(51) Int. Cl.
*B61B 11/00* (2006.01)

(52) U.S. Cl. ..... 104/178; 104/173.2; 104/180

(58) Field of Classification Search ..... 104/173.1, 104/173.2, 178, 179, 184, 187, 190, 180
See application file for complete search history.

(56) References Cited

U.S. PATENT DOCUMENTS

| | | | |
|---|---|---|---|
| 4,641,584 | A | 2/1987 | Bertrand |
| 4,843,970 | A | 7/1989 | Feuz |
| 5,105,745 | A | 4/1992 | Tarassoff |

FOREIGN PATENT DOCUMENTS

| | | | |
|---|---|---|---|
| EP | 0 275 403 | A1 | 7/1988 |
| EP | 0 461 954 | A1 | 12/1991 |
| FR | 2 605 574 | A1 | 4/1988 |

*Primary Examiner*—S. Joseph Morano
*Assistant Examiner*—Zachary Kuhfuss
(74) *Attorney, Agent, or Firm*—Oliff & Berridge, PLC

(57) ABSTRACT

A transport installation comprising an aerial rope with continuous running on which vehicles are suspended by detachable grips, comprises a transfer circuit equipped with means for moving the vehicles. The means for moving comprise at least one set of wheels with pneumatic tires one of which wheels is connected to a power take-off derived from running of the rope and equipped with drive means whereby each wheel is made to rotate by one of the adjacent wheels. One of the wheels of said set of wheels is connected by transmission means to the output shaft of an electric torque motor generating a constant turning torque independent from the speed of rotation of said output shaft.

5 Claims, 3 Drawing Sheets

TRANSPORT INSTALLATION BY AERIAL ROPE COMPRISING A VEHICLE TRANSFER CIRCUIT EQUIPPED WITH A TORQUE MOTOR

BACKGROUND OF THE INVENTION

The invention relates to a transport installation comprising a continuous running aerial rope on which vehicles are suspended by means of detachable grips, said installation having at least one terminal for loading and unloading passengers on board the vehicles, said installation comprising:

- detachment means, on entry to the terminal, to uncouple the vehicles and the rope,
- attachment means, on exit from the terminal, to recouple the vehicles and the rope,
- a transfer circuit of the vehicles equipped with means for moving the vehicles comprising at least one set of wheels with pneumatic tires, one of the wheels of which is coupled with a drive power take-off derived from the running movement of the rope, said set of wheels being equipped with drive means whereby each wheel is made to rotate by one of the adjacent wheels.

STATE OF THE ART

Conventionally in this type of installation, the transfer circuit connecting the up-line and the down-line of the rope comprises a slowing-down section equipped with a slowing-down device, a speeding-up section equipped with an accelerating device, the two sections being connected by an intermediate section wherein the vehicles run at reduced speed equipped with a driving device of the vehicles. The assembly formed by the accelerating device, the slowing-down device and the driving device form the means for moving the vehicle along the transfer circuit.

Generally, the means for moving the vehicle are formed by one or more sets of wheels with pneumatic tires staggered along the transfer circuit to cooperate by friction with a friction track borne by the grips of the vehicles. Each of these sets of wheels is equipped with drive means whereby each wheel of the set is made to rotate by one of the adjacent wheels. These drive means often comprise transmission belts or idle pinions.

To make the wheels of a set move, one of the wheels of this set can be connected to a drive power take-off derived from the running movement of the rope. Such a power take-off is in particular achieved by means of a roller sheave pressing on the rope and set in motion by the running movement of the rope.

Another possibility to make the wheels of a set move consists in using a variable speed motor which drives a transmission belt stretched between two pulleys one of which is mounted coaxially on one of the wheels, or on one of the idle pinions when the drive means comprise such pinions.

Depending on the capacity of the installation and the configuration of the terminals, the number of vehicles taken up by a given set of wheels is variable. The power required for moving these vehicles is logically proportional to the number of vehicles. Moreover, the instantaneous power recovered from the rope by the power take-off of this set is a function of the adhesion coefficient between the rope and sheave and of the normal force exerted by the rope on the sheave. The first factor depends on the type of tire (modulus of elasticity), on the temperature, on the external conditions (humidity, frost). The second factor depends on the tension of the rope, the angle of deviation of the rope on the sheave, and the maximum load admissible by the sheave.

For a given set of wheels having a power take-off derived from the rope, the instantaneous power recovered from the rope by the power take-off and transmitted to the set of wheels must at all times be equal to the sum of the power required to move the vehicles present on this set of wheels and of the power lost in particular due to the efficiencies and reduction ratios of the mechanics used. If this is not the case, this results in slipping of the roller sheave of the power take-off with respect to the rope. The risk of this slipping occurring is therefore very high when the capacity of the installation is high and/or when the external conditions are unfavorable, which is not satisfactory for the operators. The only solutions to overcome such a risk consist in over dimensioning the power take-off and/or in providing an excessive number of sets of wheels in order to increase the number of power take-offs on the transfer circuit, resulting in increased manufacturing, installation and maintenance costs of the transport installations.

The document EP0461954 describes a transport installation in which the means for moving the vehicles in the disengaged state comprises at least two consecutive sets of wheels. One of the wheels of one of the sets is connected to a power take-off derived from the rope, and one of the wheels of the other set is connected by transmission means to the output shaft of an electric motor. Along the set equipped with the electric motor, the necessary power is only delivered by the electric motor. Along the set equipped with the power take-off, the necessary power is only delivered by the power take-off. This dissociation has the purpose of defining a speed regulating section within the means for moving the vehicles to reposition the cars correctly with a preset spacing. Such a construction does not enable the problems set out above to be dealt with.

OBJECT OF THE INVENTION

The object of the invention consists in providing a transport installation able to palliate the risk of slipping of the roller sheave of a power take-off with respect to the rope in simple manner enabling the manufacturing, installation and maintenance costs to be reduced.

The installation according to the invention is remarkable in that one of the wheels of said set of wheels is connected by transmission means to the output shaft of an electric torque motor generating a constant turning torque independent of the speed of rotation of said output shaft.

According to the invention, the power transmitted to the means for moving the vehicles is provided, at all times, on the one hand by the power take-off derived from running of the rope and on the other hand from the electric torque motor. The power delivered by the torque motor being equal to multiplication of the torque supplied, which is of constant value, and of the speed of rotation of the output shaft, the torque motor therefore transmits a power of constant value to the means for moving. The rest of the necessary power is supplied by the power take-off. The power from the power take-off is therefore variable as in the prior art but reduced by a value equal to the constant power delivered by the electric torque motor, which enables any risk of slipping of the roller sheave of said power take-off with respect to the rope to be prevented very simply.

According to a preferred embodiment, the wheel coupled to the power take-off and the wheel connected to the torque motor are distinct and separated by several wheels.

Other technical features can be used either alone or in combination:

the transmission means comprise a gearing-down device the input of which is connected to the output shaft of the torque motor and the output of which comprises a drive pulley driving a transmission belt engaged in a receiver pulley mounted coaxially on the wheel of the set connected to said output shaft, the means for moving comprise at least two sets of wheels each of which comprises one wheel connected to a respective torque motor and one wheel connected to a respective power take-off.

BRIEF DESCRIPTION OF THE DRAWINGS

Other advantages and features will become more clearly apparent from the following description of a particular embodiment of the invention given as a non-restrictive example only and represented in the accompanying drawings, in which.

DESCRIPTION OF A PREFERRED EMBODIMENT OF THE INVENTION

Figure 1:
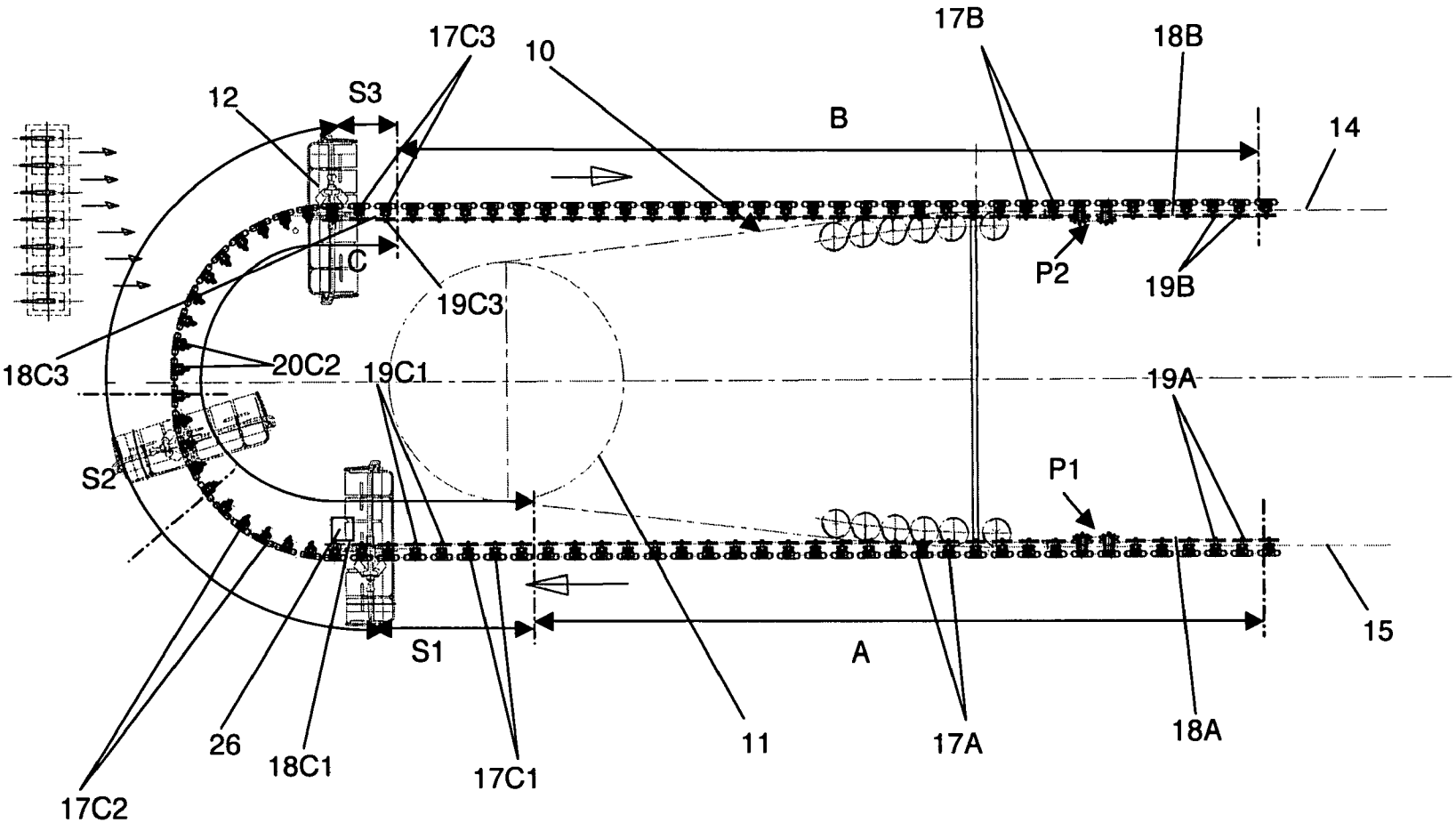
FIG. 1 schematizes the transfer circuit of a terminal of an example of a transport installation according to the invention, in top view.

An example of a transport installation according to the invention is described hereafter. An aerial rope 10 of the installation extends in a closed loop between two passenger loading/unloading terminals, respectively down-hill and up-hill, passing in the terminals on main pulleys one of which drives the rope 10 with continuous running. FIG. 1 illustrates the down-hill terminal which is equipped with a drive pulley 11. Rope 10 supports vehicles 12, for example chairs, coupled by detachable grips bearing the reference 13 in FIG. 2 and staggered along rope 10. The transport installation can comprise other intermediate terminals provided along the up-line 14 and down-line 15 of rope 10 for loading and/or unloading passengers in vehicles 12.

At the entry of the terminal, vehicles 12 are detached from down-line 15 of rope 10 by detachment means, not represented and known as such, and run on a transfer circuit (represented in FIG. 2 in cross-section) at reduced speed in the terminal until they reach up-line 14 of rope 10. A slowing-down device slows vehicles 12 detached from rope 10 down, whereas on exit an accelerating device reaccelerates them to a speed equal to that of rope 10 to enable recoupling to rope 10 without jerks by attachment means, not represented and known as such.

The slowing-down and accelerating devices are both formed by wheels with pneumatic tires staggered along a section of the transfer circuit, respectively slowing-down section A and speeding-up section B, to cooperate by friction with a friction track 16 (in FIG. 2) borne by grips 13 of vehicles 12. The wheels with pneumatic tires of the slowing-down and accelerating devices are respectively referenced 17A and 17B.

Wheels 17A of slowing-down device are coupled with one another by means of belts 18A engaged on auxiliary pulleys 19A mounted coaxially to wheels 17A. Each wheel 17A is integral to two auxiliary pulleys 19A, each cooperating respectively with a belt 18A, one of belts 18A engaging on one of auxiliary pulleys 19A of one of adjacent wheels 17A and the other of belts 18A cooperating with one of auxiliary pulleys 19A of the other of adjacent wheels 17A. For driving, at least one of wheels 17A of slowing-down device is coupled to a first driving power take-off P1 derived from the running movement of rope 10. Such a power take-off P1 is notably achieved by means of a roller sheave pressing on rope 10 and set in motion by running of rope 10. The roller sheave can set a fixedly attached pulley in motion, the latter transmitting a rotational movement, by means of a transmission belt, to a pulley fixedly attached to wheel 17A connected to power take-off P1. The roller sheave can also be directly secured fixedly to wheel 17A connected to power take-off P1. For the purpose of driving wheels 17B, the accelerating device implements a similar solution with at least one wheel 17B coupled to a second power take-off P2, belts 18B and auxiliary pulleys 19B. Power take-off P2 of the accelerating device is, in non-restrictive manner, distinct from that of the slowing-down device.

Slowing-down section A and speeding-up section B of the transfer circuit are joined by an intermediate section C along which vehicles 12 run continuously at reduced speed by means of a driving device formed by wheels with pneumatic tires. Intermediate section C is subdivided into three successive parts S1, S2, S3. First part S1 is straight, extends slowing-down section A downstream, and is equipped with wheels referenced 17C1 belonging to the reduced speed driving device. Last part S3 is straight, extends speeding-up section B upstream, and is equipped with wheels referenced 17C3 belonging to the reduced speed driving device. Intermediate part S2 is semi-circular and joins first and last parts S1 and S3. The wheels of semi-circular part S2 are referenced 17C2 and driven in synchronism with one another, for example by idle pinions, (not represented) inserted between transmission pinions 20C2 (FIG. 1) mounted coaxially with wheels 17C2. Wheels 17C1 and 17C3 of straight parts S1 and S3 are for example mutually driven in a similar way to wheels 17A, 17B of slowing-down and accelerating devices, with respectively auxiliary pulleys 19C1, 19C3 on each wheel 17C1, 17C3 and belts 18C1, 18C3. One of wheels 17C1 of first part S1 is driven in rotation by one of wheels 17A of slowing-down section A. In like manner, one of wheels 17C3 of last part S3 is driven in rotation by one of wheels 17B of speeding-up section B. Driving of wheels 17C2 of intermediate part S2 can be performed by one of wheels 17C1, 17C3 of at least one of adjacent parts S1, S3.

It is clear that the number of parts of intermediate section C can be different from three depending on the type of equipment involved. For example, part S1 and/or part S3 can be eliminated.

It is clearly apparent from the above that the transfer circuit of vehicles 12 is equipped with means for moving the vehicles constituted by the assembly formed by the slowing-down device, the reduced speed driving device and the accelerating device. Wheels 17A of the slowing-down device, to which wheels 17C1 of first part S1 of intermediate section C are added, to which can be added, when this is the case, wheels 17C2 of intermediate part S2 which are driven by one of wheels 17C1 of first part S1, constitute a first set of wheels with pneumatic tires. In identical manner, wheels 17B of the accelerating device, to which wheels 17C3 of last part S3 of intermediate section C are added, to which can be added, when this is the case, wheels 17C2 of intermediate part S2 which are driven by one of wheels 17C3 of last part S3, constitute a second set of wheels with pneumatic tires.

Each of the first and second sets of wheels comprises a wheel, respectively one of wheels 17A and 17B, connected to a respective power take-off P1, P2. Each of the sets also comprises drive means whereby each wheel of the set is made to rotate by one of the adjacent wheels of the same set. For the first set, these drive means are formed, for wheels 17A of the slowing-down device and for those 17C1 of the part of the reduced speed driving device equipping first part S1, by all the pairs of auxiliary pulleys 19A and 19C1 mounted on these wheels and by associated belts 18A and 18C1. When the first set also includes at least one of wheels 17C2 of the part of the reduced speed driving device equipping intermediate part S2, the drive means of the first set also comprise pinions 20C2 mounted coaxially on these wheels 17C2 and the intercalated idle pinions. In exactly the same way for the second set, the drive means which the latter comprises are formed, for wheels 17B of the accelerating device and for those 17C3 of the part of the reduced speed driving device equipping last part S3, by all the auxiliary pulleys 19B and 19C3 mounted on these wheels and by associated belts 18B and 18C3. When the second set also includes at least one of wheels 17C2 of the part of the reduced speed driving device equipping intermediate part S2, the drive means of the second set also comprise pinions mounted 20C2 coaxially on these wheels 17C2 and the intercalated idle pinions.

Figure 2:
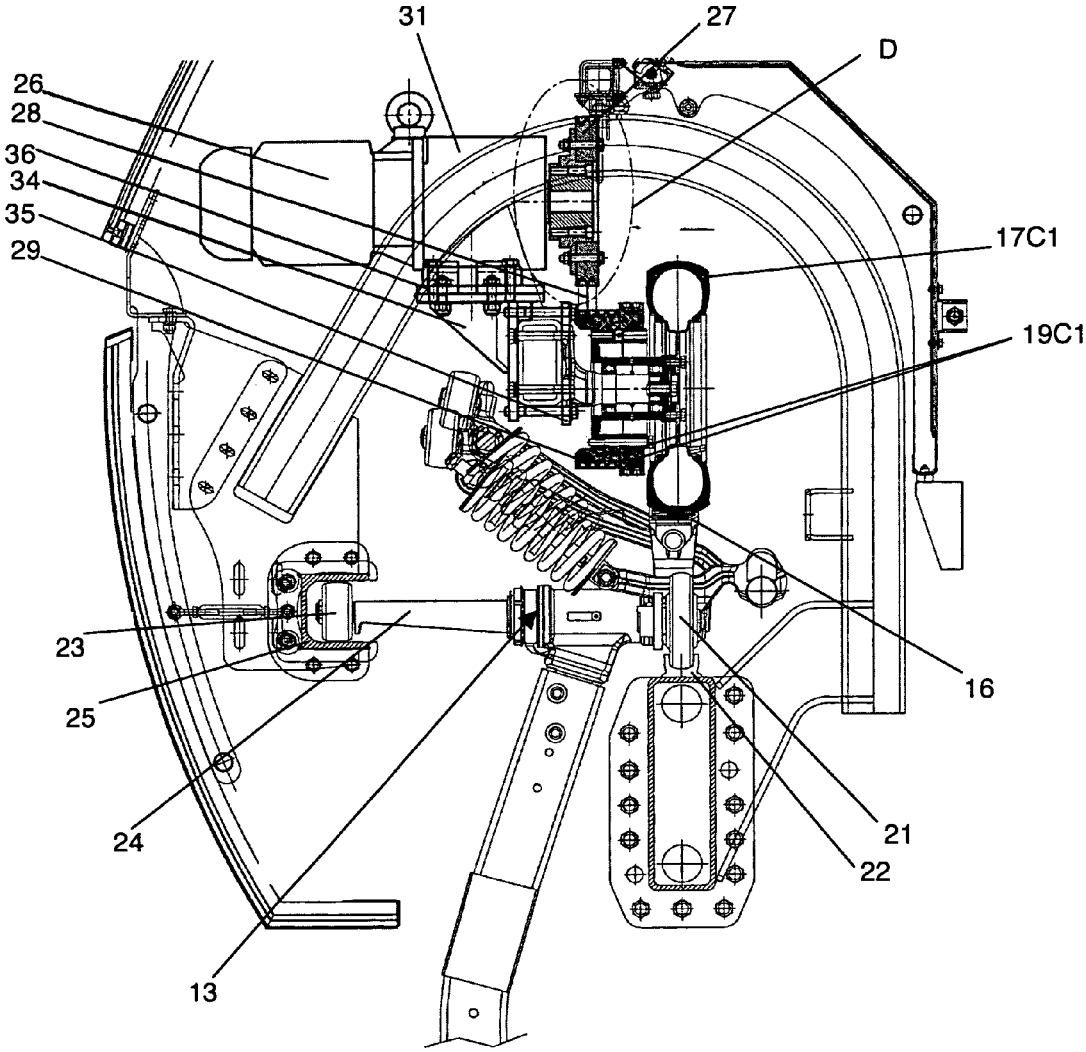
FIG. 2 represents the transfer circuit of FIG. 1 in transverse cross-section at the level of the electric torque motor.

FIG. 2 illustrates first part S1 of intermediate section C of the transfer circuit of FIG. 1, in transverse cross-section near the junction between first part S1 and intermediate part S2. In conventional manner, the transfer circuit is equipped with means for guiding the detached vehicles 12. The body of grip 13 bears a first roller sheave 21 to move grip 13 detached from rope 10 on a first transfer rail 22 performing lateral guiding of grip 13. First transfer rail 22 presents a U-shaped cross-section open upwards to receive first roller sheave 21. To prevent grip 13 (and therefore associated vehicle 12) from rotating, the body of grip 13 comprises a second roller sheave 23 mounted on the end of an overhanging support arm 24. Second roller sheave 23 is mounted in a second transfer rail 25 parallel to the first but offset laterally towards the inside of the transfer circuit. Second transfer rail 25 presents a U-shaped cross-section open laterally in the direction of first transfer rail 22. Such a grip 13 is well known and does not need to be described in greater detail here.

According to the invention and with reference to the figures, one of the wheels of the first set of wheels defined above is connected to the output shaft of an electric torque motor 26. For example purposes and as represented, torque motor 26 is connected to one of the last wheels of the first set (seen in the running direction of vehicles 12), such as for example to one of the last wheels 17C1 of first part S1 of reduced speed intermediate section C. Torque motor 26 is secured above wheel 17C1 to which its output shaft is connected, with an offset towards the inside of the transfer circuit, by means of a motor support 34 at right angles, the side of which facing wheel 17C1 is fixed to a counterplate 35. The side of motor support 34 facing reducing gear 31 is for its part fixed to an adjustment plate 36 for adjusting the lateral positioning of torque motor 26.

Figure 3:
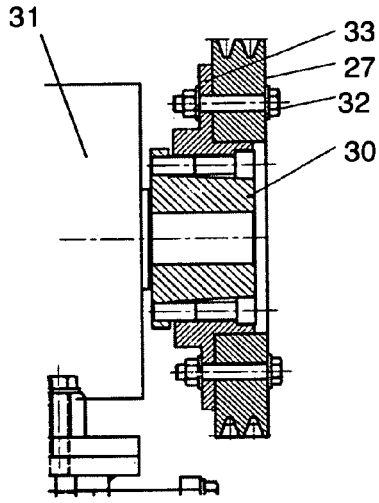
FIG. 3 illustrates the detail bearing the reference D in FIG. 2.
Figure 4:
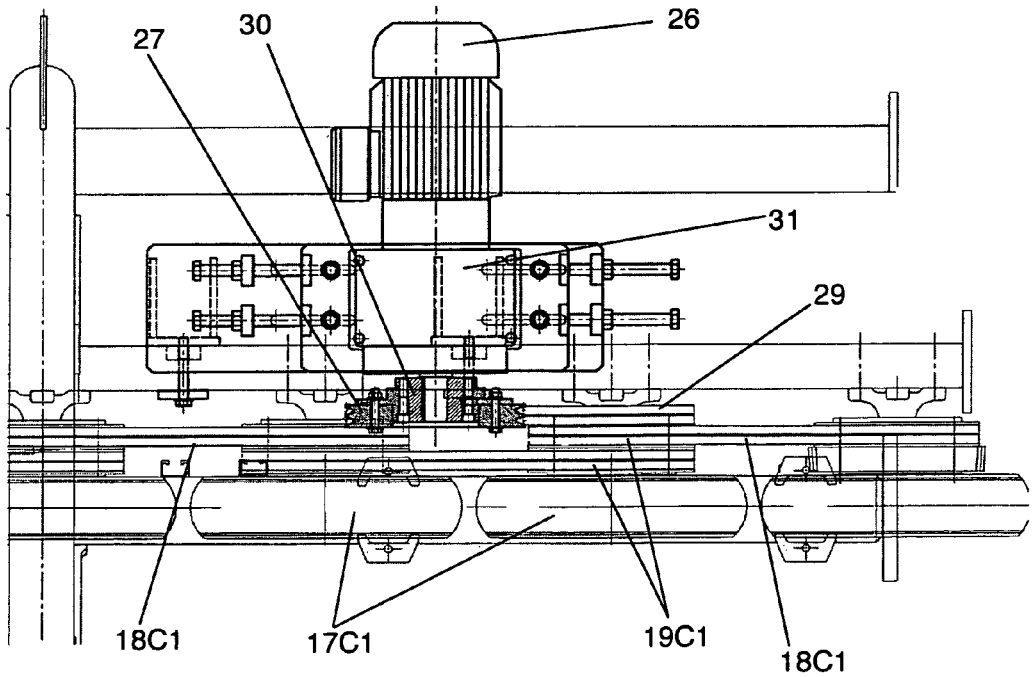
FIG. 4 is a top view of a part of the transfer circuit.

With reference to FIG. 2, the connection between wheel 17C1 and the output shaft of torque motor 26 is achieved by transmission means comprising for example a gearing-down device 31 the input of which is coupled to the output shaft of torque motor 26 and the output of which comprises a drive pulley 27 driving a transmission belt 28 engaged at its opposite end in a receiver pulley 29 mounted coaxially on wheel 17C1 of the first set connected to the output shaft of torque motor 26. FIG. 2 illustrates that receiver pulley 29 is fixedly secured to the pair of auxiliary pulleys 19C1 mounted on wheel 17C1 of the first set connected to the output shaft of torque motor 26. In FIG. 2, belts 18C1 are not represented for the sake of clarity. Detail D of FIG. 2 is illustrated in FIG. 3 and represents assembly of the drive pulley 27 by clamping by means of bolts 32 against a radial plate 33 fitted on a hub 30 fixedly secured to the output of gearing-down device 31. It is clear that any equivalent type of transmission means can be used without departing from the scope of the invention, for example by means of an assembly with transmission by pinions.

Torque motor 26 in known manner generates a constant turning torque independent from the speed of rotation of its output shaft. The power delivered by torque motor 26 is equal to multiplication of the torque supplied to the output shaft, which is of constant value, and of the speed of rotation of the output shaft. For a given running speed of rope 10, torque motor 26 therefore transmits a power of constant value to wheel 17C1 to which it is connected, and therefore transmits a constant power to the means for moving the vehicles.

For the first set of wheels, the power transmitted to the means for moving the vehicles 12 comes, at all times, on the one hand from power take-off P1 derived from running of rope 10, and on the other hand from electric torque motor 26. The instantaneous power supplied by power take-off P1 and by torque motor 26 to the means for moving must, at all times, be equal to the sum of the power necessary to move vehicles 12 present on this set of wheels and of the power lost in particular due to the efficiencies and reduction ratios of the mechanics used. If this is not the case, this results in slipping of the roller sheave of power take-off P1 with respect to rope 10.

Depending on the capacity of the installation and the configuration of the terminals, the number of vehicles 12 taken up by the first set of wheels is variable. The power necessary to move these vehicles 12 is logically proportional to the number of vehicles 12. The power transmitted by torque motor 26 being constant, this variation of the power necessary to move vehicles 12 is compensated by a corresponding variation of the instantaneous power supplied by power take-off P1 of the first set. The power coming from power take-off P1 is therefore variable as in the prior art, but reduced by a value equal to the constant power delivered by torque motor 26, which enables any risk of slipping of the roller sheave of power take-off P1 with respect to rope 10 to be prevented very simply.

Torque motor 26 further presents the advantage of delivering a constant torque whatever the running speed of rope 10 without requiring any additional electronic device, or even a servo-control device. Torque motor 26 thereby performs its function, in downgraded operation of the installation, by a simple electric power supply. Such a torque motor 26 moreover presents the advantage of being able to be installed very simply and at low cost on new or already existing installations.

The choice of the wheel of the first set that is connected to torque motor 26 presents an importance on operation of the first set. In the example described, torque motor 26 is connected to the penultimate wheel 17C1 of first part S1 of reduced speed intermediate section C, which enables wheel 17A connected to power take-off P1 associated with the first set and wheel 17C1 connected to torque motor 26 to be distinct and separated by several wheels 17A and 17C1. Such a configuration, in the event of absence of vehicles 12 on the first set of wheels and for the worst climatic conditions, limits the risk of the power supplied by torque motor 26 exceeding the energy dissipation capacity by the drive means of the wheels of the set and by friction of the roller sheave of power take-off P1 on rope 10. Exceeding this capacity would cause slipping of belts 18A, 18C1 and/or of the roller sheave. Nevertheless, the choice of the wheel of the first set to which torque motor 26 is connected is not restrictive in the invention. In other words, torque motor 26 can be connected to any wheel 17A, 17C1, or even 17C2, without departing from the scope of the invention.

Finally, the second set of wheels defined above can also be equipped with a torque motor (not represented) connected to one of its wheels 17B, 17C3 and even 17C2. In this case, the means for moving vehicles 12 along the transfer circuit comprise two sets of wheels each of which comprises a wheel connected to a respective torque motor and a wheel connected to a respective power take-off P1, P2. In particular, the torque motor associated with the second set of wheels can be connected to one of the first wheels 17C3 (seen in the running direction of vehicles 12) of last part S3 of reduced speed intermediate section C. It is clear that the number of sets of wheels each of which comprises a wheel connected to a respective torque motor and a wheel connected to a respective power take-off can be more than two without departing from the scope of the invention.

The invention claimed is:

1. A transport installation comprising a continuous running aerial rope on which vehicles are suspended by means of detachable grips, said installation having at least one terminal for loading and unloading passengers on board the vehicles, said installation comprising:

detachment means, on entry to the terminal, to uncouple the vehicles and the rope;

attachment means, on exit from the terminal, to recouple the vehicles and the rope;

a transfer circuit of the vehicles equipped with means for moving the vehicles comprising:

at least one set of wheels with pneumatic tires;

one of the wheels of which is coupled with a drive power take-off derived from the running movement of the rope;

said set of wheels being equipped with drive means whereby each wheel is made to rotate by one of the adjacent wheels, wherein another one of the wheels of said set of wheels is connected by transmission means to an output shaft of an electric torque motor generating a constant turning torque independent from the speed of rotation of an output of the transmission means.

2. The installation according to claim 1, wherein the wheel coupled to the power take-off and the wheel connected to the torque motor are distinct and separated by several wheels.

3. The installation according to claim 2, wherein the transfer circuit comprises a slowing-down section equipped with a slowing-down device, a speeding-up section equipped with an accelerating device, joined by an intermediate section along which the vehicles run at reduced speed equipped with a driving device at reduced speed, said slowing-down, accelerating and reduced speed driving devices constituting the means for moving the vehicles, the wheel connected to the torque motor belonging to said reduced speed driving device.

4. The installation according to claim 1, wherein the transmission means comprise a gearing-down device the input of which is connected to the output shaft of the torque motor and the output of which comprises a drive pulley driving a transmission belt engaged in a receiver pulley mounted coaxially on the wheel of the set connected to said output of the transmission means.

5. The installation according to claim 1, wherein the means for moving comprise at least two sets of wheels each of which comprises a wheel connected to a respective torque motor and a wheel connected to a respective power take-off.

* * * * *